US009068401B2

(12) United States Patent
Wiedmer et al.

(10) Patent No.: US 9,068,401 B2
(45) Date of Patent: Jun. 30, 2015

(54) WORKOVER RIG WITH REINFORCED MAST

(75) Inventors: Greg Wiedmer, Kenmare, ND (US); Thomas Edwin Mau, Kenmare, ND (US); Robert Eugene Mau, Kenmare, ND (US)

(73) Assignee: MW INDUSTRIES, INC., Kenmare, ND (US)

( * ) Notice: Subject to any disclaimer, the term of this patent is extended or adjusted under 35 U.S.C. 154(b) by 0 days.

(21) Appl. No.: 13/585,366

(22) Filed: Aug. 14, 2012

(65) Prior Publication Data

US 2013/0180702 A1 Jul. 18, 2013

Related U.S. Application Data

(63) Continuation of application No. 12/877,759, filed on Sep. 8, 2010, now abandoned, which is a continuation of application No. 11/772,851, filed on Jul. 3, 2007, now abandoned.

(60) Provisional application No. 60/895,026, filed on Mar. 15, 2007.

(51) Int. Cl.

| | |
|---|---|
| ***B66C 23/06*** | (2006.01) |
| ***B66C 23/62*** | (2006.01) |
| ***E04H 12/34*** | (2006.01) |
| ***E04H 12/00*** | (2006.01) |
| ***E21B 15/00*** | (2006.01) |
| ***E21B 7/02*** | (2006.01) |
| *B66C 23/70* | (2006.01) |
| *E04H 12/18* | (2006.01) |

(52) U.S. Cl.

CPC ..... *E21B 15/00* (2013.01); *B66C 23/705* (2013.01); *B66C 23/701* (2013.01); *E04H 12/182* (2013.01); *B66C 23/707* (2013.01); *E21B 7/023* (2013.01)

(58) Field of Classification Search

CPC ..... E21B 15/00; E21B 7/023; B66C 23/705; B66C 23/701; B66C 23/707; E04H 12/182

USPC ..... 52/651.01–651.07, 112, 117, 118, 116, 52/121

See application file for complete search history.

(56) References Cited

U.S. PATENT DOCUMENTS

| | | | | | |
|---|---|---|---|---|---|
| 2,336,432 | A | * | 12/1943 | Wilson | 182/69.4 |
| 2,715,954 | A | * | 8/1955 | Rowan | 52/115 |
| 2,742,260 | A | * | 4/1956 | Patterson | 254/399 |
| 3,016,992 | A | * | 1/1962 | Wilson | 52/115 |
| RE29,541 | E | * | 2/1978 | Russell | 175/52 |
| 4,371,041 | A | * | 2/1983 | Becker et al. | 173/28 |
| 4,440,262 | A | * | 4/1984 | Hunt et al. | 182/114 |
| 2003/0172599 | A1 | * | 9/2003 | Frink | 52/116 |
| 2007/0272907 | A1 | * | 11/2007 | Mosley | 254/386 |
| 2008/0210416 | A1 | * | 9/2008 | Lesko | 166/85.5 |

* cited by examiner

*Primary Examiner* — Phi A
*Assistant Examiner* — Omar Hijaz
(74) *Attorney, Agent, or Firm* — Marsh Fischmann & Breyfogle LLP

(57) ABSTRACT

A reinforced workover rig mast (40) is disclosed. A top section (60) of the mast (40) telescopes relative to a mid section (44), and includes a scoping cylinder area (72) for receiving a scoping cylinder (90) that may be used to extend and retract the top section (60). A number of external gussets (78) are located within this scoping cylinder area (72) to structurally reinforce the upper section (60). Other reinforcement features are incorporated by the mast (40) as well, including an increased width and depth, along with a reduced vertical spacing between adjacent cross supports (50*b*, 66*b*, 74).

8 Claims, 11 Drawing Sheets

WORKOVER RIG WITH REINFORCED MAST

CROSS-REFERENCE TO RELATED APPLICATIONS

This patent application is a continuation of U.S. patent application Ser. No. 12/877,759, that was filed on Sep. 8, 2010 now abandoned, which is a continuation of U.S. patent application Ser. No. 11/772,851, that was filed on Jul. 3, 2007 now abandoned, which claims priority under 35 U.S.C. §119 (e) to U.S. Provisional Patent Application Ser. No. 60/895,026, that was filed on Mar. 15, 2007. Priority is claimed to each of the above-noted patent applications, and the entire disclosure of each of the above-noted patent applications is hereby incorporated by reference in their entirety herein.

FIELD OF THE INVENTION

The present invention generally relates to the field of service or workover rigs and, more particularly, to the derrick or mast used by such rigs.

BACKGROUND OF THE INVENTION

Two general categories of rigs include drilling rigs and service/workover rigs. Drilling rigs are used to drill wells (e.g., oil, natural gas), while service/workover rigs are used to service or work existing wells for any appropriate reason. Representative servicing or workovers of existing wells includes without limitation replacing one or more components (including downhole components) associated with the well (e.g., tubing, valves, seals, flanges, blowout preventers), directing one or more components into the well for any appropriate purpose (e.g., a tool for opening a downhole blockage), executing one or more well operations (e.g., fracturing, acidizing), or the like.

Both drilling and service/workover rigs typically use a derrick or mast that supports one or more pulleys, one or more block and tackles, or the like. Various lines, cable, or the like may be directed around one or more of these pulleys/block and tackles to lift the desired component(s) and/or to lower the desired component(s) as desired/required. These lines or cables are anchored to what is commonly referred to in the art as a drawworks. An appropriate power source (e.g., a right angle drive) rotates one or more drums of the drawworks in one direction to wind the line/cable around one or more drums of the drawworks to lift the desired component(s), while the power source rotates one or more drums of the drawworks in the opposite direction to unwind the line/cable from one or more drums of the drawworks to lower the desired component(s). "Cable" is commonly viewed as being of a heavier grade than "line," and thereby more appropriate for handling heavier components. Cable is commonly associated with a main drum of a drawworks, while line is commonly associated with a sand drum of a drawworks. Service or workover rigs use a drawworks having both a main drum and a sand drum, while drilling rigs typically only use a main drum.

The mast or derrick of service/workover rigs oftentimes extends in excess of 90 feet. Many service/workover rigs are incorporated by a truck/tractor for transporting the same from location to location. Moreover, the mast is typically movable between a stowed position (e.g., at least generally horizontal, and including for transportation purposes) and a deployed position (e.g., at least generally vertical, although in practice most masts are disposed at a small angle relative to vertical). In addition to being deployable, the mast should be designed to accommodate the loads that will be experienced during operation of the service/workover rig.

SUMMARY OF THE INVENTION

A first aspect of the present invention is generally directed to a service or workover rig mast that includes at least a first mast section. The first mast section includes a frame, what may be characterized as a pocket or a scoping cylinder area within the frame, and a plurality of gussets. The scoping cylinder area may be in the form of a space for accommodating a component or combination of components that may be used to deploy the first mast section (e.g., a scoping cylinder), such as to pivot the first mast section and/or extend the first mast section to move the first mast section between a stowed position and a deployed position. In any case, each gusset is both disposed within the scoping cylinder area and is appropriately anchored to the frame.

Various refinements exist of the features noted in relation to the first aspect of the present invention. Further features may also be incorporated in the first aspect of the present invention as well. These refinements and additional features may exist individually or in any combination. The workover rig mast may be incorporated by a service or workover rig of any appropriate size, shape, configuration, and/or type. In one embodiment, the first mast section defines an uppermost portion of the workover rig mast. The first mast section may also be characterized as incorporating what is commonly referred to in the art as the "crown" of a workover rig.

The workover rig mast may also incorporate a second mast section in a manner such that the first mast section telescopes relative to the second mast section and extends to a higher elevation than the second mast section when the workover rig mast is moved from a stowed position (e.g., where the workover rig mast is at least generally horizontally disposed or oriented) to a deployed position (e.g., where the workover rig mast is at least generally vertically disposed or oriented, and including where the workover rig mast is disposed within a small angle of absolute vertical). This second mast section may be in the form of a three-sided structure in a view corresponding with a cross-section taken perpendicularly to the length of the second mast section. In one embodiment, the width of the second mast section is measured between opposing closed sides of the second mast section, while the depth of the second mast section is measured between an open end of the second mast section and an opposing closed end of the second mast section.

In one embodiment and in relation to the above-noted general configuration for the second mast section: 1) its width is at least about 8 feet; 2) its depth is at least about 4 feet; 3) it may incorporate a plurality of what may be characterized as second cross support assemblies (e.g., "internal" C-girts) that are spaced along the length of the second mast section by a distance of no more than about 5 feet (e.g., where each second cross support assembly includes three commonly oriented cross supports). These dimensional features may be utilized individually and in all combinations in relation to the workover rig mast. Moreover, one embodiment has each of the noted second cross support assemblies being disposed within a corresponding plane that is orthogonal to the length of the second mast section (e.g., the various second cross support assemblies may be characterized as being disposed within a plurality of spaced, parallel planes). Further in this regard, the second mast section may further include a plurality of diagonal supports, where each such diagonal support at least generally extends between a corresponding adjacent pair of second cross support assemblies (i.e., each diagonal support of the second mast section is not required to extend between the same two second cross support assemblies). Each such diagonal support may be appropriately attached to a corresponding second cross support assembly and/or a corresponding corner support or derrick leg.

The first mast section may incorporate a plurality of what may be characterized as first cross support assemblies (e.g., "internal" C-girts) that are spaced along the length of the first mast section by a distance of no more than about 5 feet (e.g., where each first cross support assembly includes three commonly oriented first cross supports). A first mast section of this particular type may be utilized for any of the configurations noted herein, including in combination with a second mast section having the above-noted 5 foot maximum spacing between adjacent second cross support assemblies. Moreover, one embodiment has each of the noted first cross support assemblies being disposed within a corresponding plane that is orthogonal to the length of the first mast section (e.g., the various first cross support assemblies may be characterized as being disposed within a plurality of spaced, parallel planes). Further in this regard, the first mast section may further include a plurality of diagonal supports, where each such diagonal support at least generally extends between a corresponding adjacent pair of first cross support assemblies (i.e., each diagonal support of the first mast section is not required to extend between the same two first cross support assemblies). Each such diagonal support may be appropriately attached to a corresponding first cross support assembly and/or a corresponding corner support or derrick leg.

The above-noted general configuration for the second mast section may be characterized as including a plurality of second perimeter supports that collectively define the above-noted three-sided structure. Each of these second perimeter supports may be further characterized as being disposed within a plane that is orthogonal to the length of the second mast section, where a spacing of no more than about 5 feet exists between each adjacent pair of second perimeter supports that are aligned and spaced in a dimension corresponding with the length of the second mast section.

The above-noted general configuration for the second mast section may also be characterized as including a plurality of second cross supports that are each disposed in a common orientation. Such a "common orientation" may be where each such second cross support is co-planar with one or more other second cross supports, is parallel with one or more other second cross supports, or both. In any case and in one embodiment, each adjacent pair of second cross supports that are both aligned and spaced in a dimension corresponding with the length of the second mast section are separated by distance of no more than about 5 feet.

The first mast section may include a plurality of first cross supports that are each disposed in a common orientation. Such a "common orientation" may be where each such first cross support is co-planar with one or more other first cross supports, is parallel with one or more other first cross supports, or both. In any case and in one embodiment, each adjacent pair of first cross supports that are both aligned and spaced in a dimension corresponding with the length of the first mast section are separated by distance of no more than about 5 feet. A first mast section of this particular type may be utilized for any of the configurations noted herein, including in combination with a second mast section having the above-noted 5 foot maximum spacing between adjacent second cross supports that are aligned and spaced from each other in a dimension corresponding with the length of the second mast section. In one embodiment, the various first cross supports and the various second cross supports are disposed in the same orientation.

The above-noted general configuration for the second mast section may also be characterized as including first, second, third, and fourth corner supports or derrick legs, where each such corner support extends in or defines a length dimension of the second mast section. Consider the case where a reference plane extends between the outer perimeter of each of the four adjacent pairs of the corner supports. In this case, the second mast section may further include a plurality of cross supports, where each such cross support extends between and is anchored to only a corresponding pair of the first, second, third, and fourth corner supports, and where each such cross support fails to protrude beyond the corresponding reference plane (e.g., to define an "internal" C-girt). This particular "corresponding pair" may be any two of the first, second, third, and fourth corner supports. That is, each cross support need not extend between and be anchored to the same two corner supports. For instance, one cross support could extend between and be anchored to the first and second corner supports, while another cross support could extend between and be anchored to the third and fourth corner supports. Another related characterization is that second mast section may lack any "external" C-girts, where an external C-girt would be an at least generally C-shaped structure that would be disposed on the outside of the noted first, second, third, and fourth corner supports to define one open side or end for the second mast section.

The workover rig mast may be of a light-weight construction. One characterization in this regard is that the workover rig mast has a weight of no more than about 22,000 pounds and a length of at least about 95 feet in one embodiment. Another characterization in this regard is that the workover rig mast weighs no more than about 210 pounds per linear foot in the length dimension in another embodiment. Yet another characterization in this regard is that a frame of the first mast section is defined by ASTM 500 Grade C steel in yet another embodiment.

A number of characterizations may be made in relation to the gussets utilized by the first mast section of the workover rig mast, and which are applicable to each of the various configurations presented herein. Each gusset may be characterized as being located in a corresponding corner of the frame within the scoping cylinder area. In the case where the length of the first mast section extends in or defines a first dimension, a plurality of gusset groups may be spaced along the first dimension or length of the first mast section, and where each gusset group includes at least one and more typically a plurality of gussets. In one embodiment, a length dimension of each gusset in a common gusset group is disposed within a common plane that is orthogonal to the first dimension, which again corresponds with or defines the length of the first mast section.

Each gusset may also be characterized as having first and second ends. In one embodiment, the first and second ends of the gussets in a common gusset group are disposed in a common plane that is orthogonal to the length dimension of the first mast section. In another embodiment, the first and second ends of a first plurality of gussets are disposed in a common first plane that is orthogonal to the length dimension of the first mast section, while the first and second ends of a second plurality of gussets are disposed in a common second plane that is also orthogonal to the length dimension of the first mast section.

The frame of the first mast section may be characterized as including first, second, third, and fourth corner supports or derrick legs that each extend in or define a length dimension of the first mast section. One end of each of the various gussets may be fixed to either the first or the second corner support (e.g., not all gussets need to be fixed to the same corner support; one or more gussets may be fixed to the first corner support, and one or more gussets may be fixed to the second corner support). An opposite end of each of the various gussets may be fixed to a corresponding one of a plurality of internally disposed cross members of the frame. Not all gussets need to be fixed to the same internally disposed cross member. For instance, one pair of gussets may be fixed to a first internal cross member, while another pair of gussets may be fixed to a second internal cross member that is spaced from the first internal cross member along the length dimension of the first mast section.

A second aspect of the present invention is generally directed to a service or workover rig mast that includes first and second mast sections. The first mast section telescopes relative to the second mast section, and extends to a higher elevation than the second mast section when the workover rig mast is in a deployed position versus a stowed position (e.g., the second mast section is closer to the ground when the workover rig mast is in its deployed position). Furthermore, the first mast section includes a frame, that in turn includes first, second, third, and fourth corner supports or derrick legs, along with a plurality of gussets. One end of each of the gussets is fixed to either the first corner support or the second corner support (e.g., one or more of the gussets may be fixed to the first corner support, while one or more of the gussets may be fixed to the second corner support), while the opposite end of each of gusset is fixed to a corresponding one of a plurality of internally disposed cross members of the frame (e.g., one or more of the gussets may be fixed to a first internal cross member, while one or more of the gussets may be fixed to a second internal cross member that is spaced from the first internal cross member along the length of the first mast section). The various features discussed above in relation to the first aspect may be used by this second aspect, alone or in any combination.

DETAILED DESCRIPTION

Figure 1:
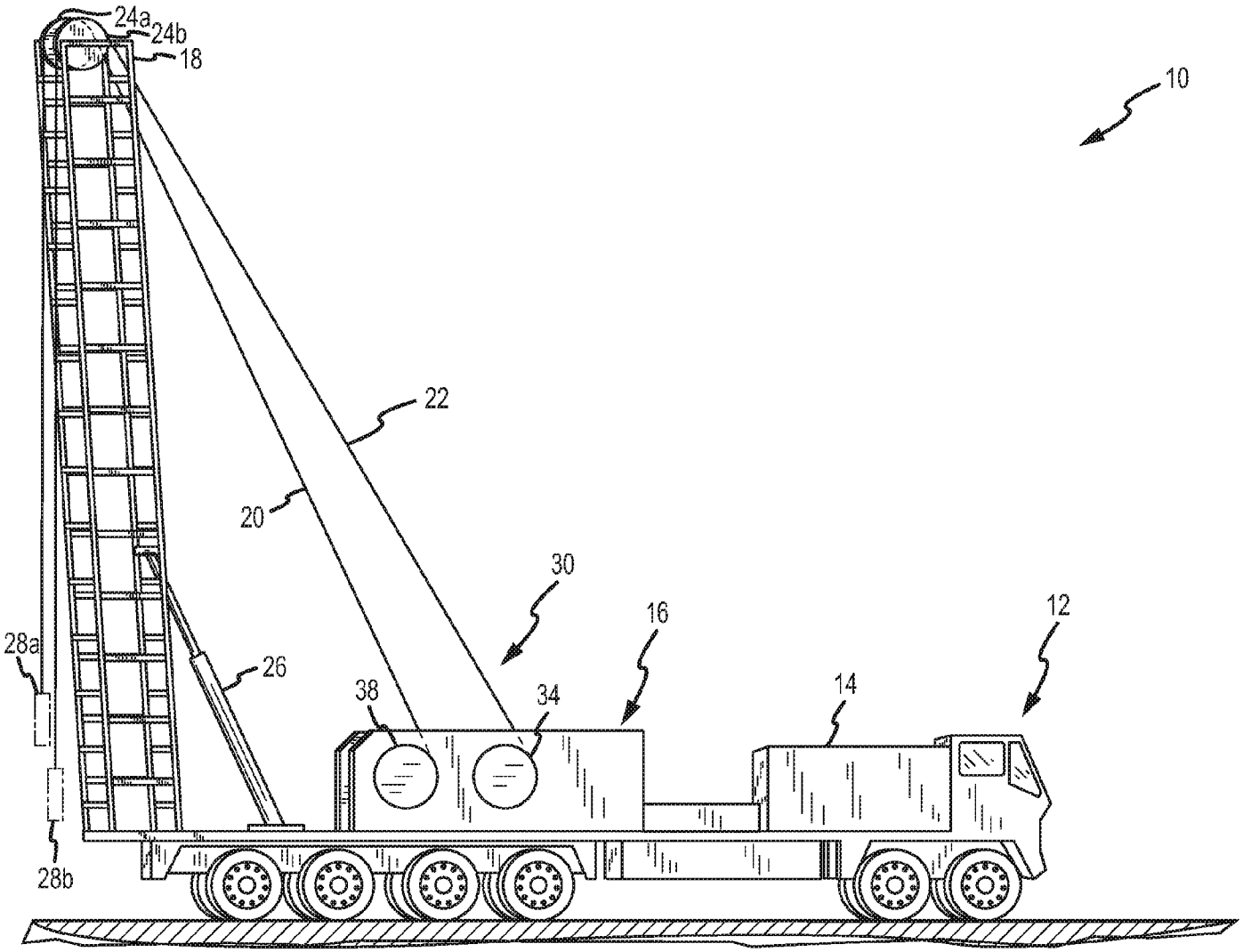
FIG. 1 is a perspective view of one embodiment of a service or workover rig with its mast being in a deployed position.

FIG. 1 schematically illustrates one configuration of a service or workover rig 10. The workover rig 10 is incorporated on an appropriate carrier 12 on which a collapsible derrick or mast 18 is mounted. The derrick 18 may be of any appropriate size, shape, and/or configuration. A derrick lift or raising ram 26 of any appropriate size, shape, configuration, and/or type (e.g., one or more hydraulic cylinders) may be used to both raise the derrick 18 to the position illustrated in FIG. 1, and to lower the derrick 18 back into a transport position on the carrier 12 (not shown, but where the derrick 18 is in an at least generally prone or horizontal position).

The workover rig 10 further includes a drawworks 30 having both a main drum 38 and a sand drum 34. A cable 20 is typically associated with the main drum 38, while a wire line 22 is typically associated with the sand drum 34 (e.g., the cable 20 generally being more robust or stronger than the wire line 22, and thereby accommodating a higher or heavier load). Each of the cable 20 and wire line 22 may be of any appropriate size, shape, configuration, and/or type (each being of an at least generally elongated configuration and sufficiently flexible so as to be able to wrap around the associated main drum 38 or sand drum 34). The cable 20 is anchored to the main drum 38 and extends through a crown schieve 24*a* on the derrick 18 (and typically through one or more other schieves on the derrick 18—not shown), while the wire line 22 is anchored to the sand drum 34 and extends through another crown schieve 24*b* on the derrick 18. The crown schieves 24*a*, 24*b* are only schematically illustrated in FIG. 1. Each of the crown schieve 24*a* and the crown schieve 24*b* may include one or more pulleys, one or more block and tackles, or both, and each component of each crown schieve 24*a*, 24*b* may be disposed at one or more locations on the derrick 18 and further disposed in any appropriate arrangement.

A component 28*a* is schematically illustrated in FIG. 1 as being suspended from the cable 20 "downstream" of the associated crown schieve(s) 24*a*, while a component 28*b* is schematically illustrated in FIG. 1 as being suspended from the wire line 22 "downstream" of the associated crown schieve 24*b*. Typically, only one of the cable 20 and wire line 22 will be used at any one time (i.e., the other will be appropriately secured out of the way, for instance "tied" to the derrick 18). Each of the components 28*a*, 28*b* may be of any appropriate size, shape, configuration, and/or type. The component 28*a* will typically be one that is used by the well that is being serviced by the workover rig 10, while the component 28*a* will typically be a test instrument or the like that is directed into the well hole during servicing of the well.

The drawworks 30 is used to raise and lower the component 28*a* via the cable 20 and rotation of the main drum 38, while the drawworks 30 is used to raise and lower the component 28*b* via the wire line 22 and rotation of the sand drum 34. In this regard and for the illustrated embodiment, an engine/ transmission 14 (only schematically illustrated) of the carrier 12 is also used to operate a right angle drive 16 (only schematically illustrated), which in turn is used to power the drawworks 30 (e.g., to rotate the sand drum 34, and which may also then rotate the main drum 38).

Figure 2A:
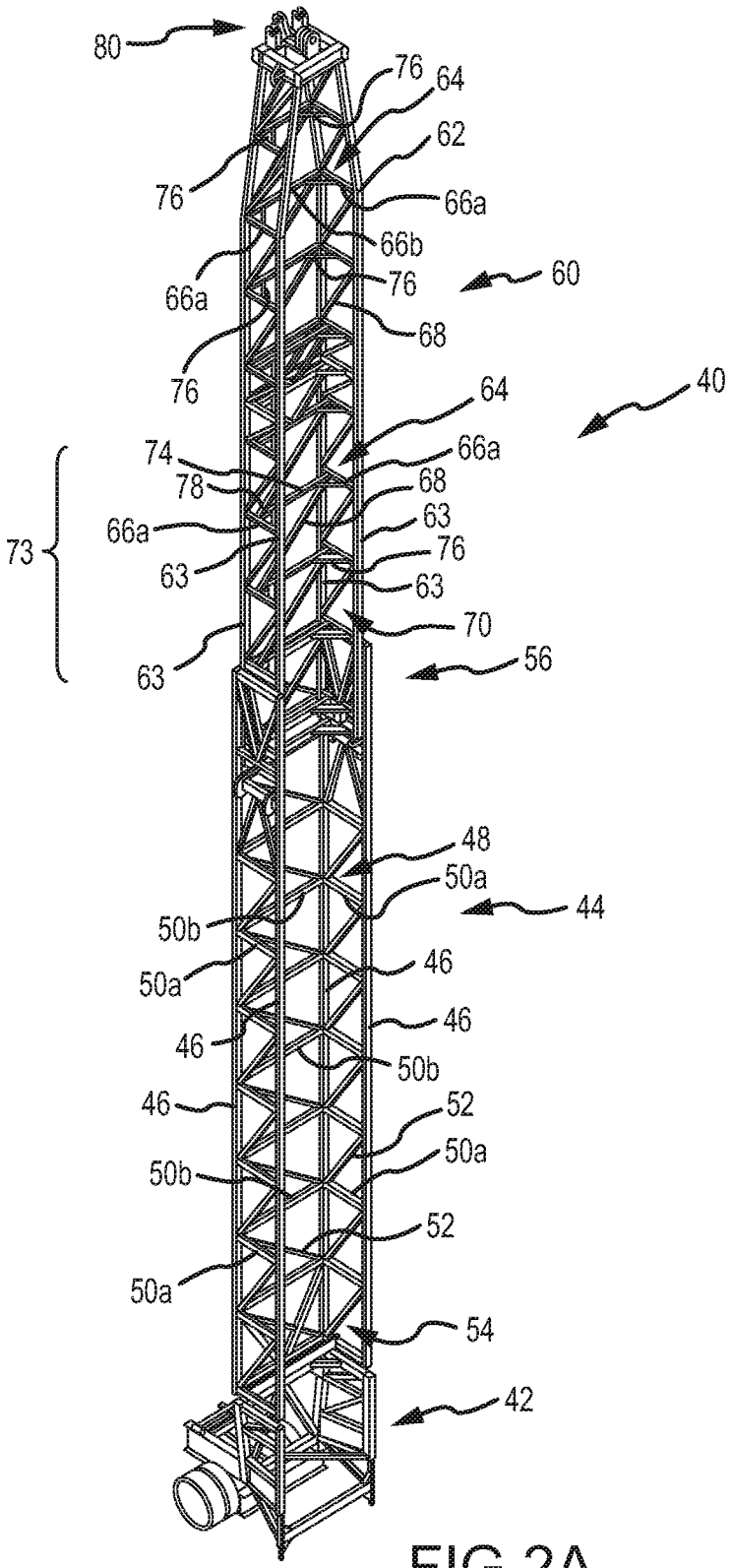
FIG. 2A is a perspective view of one embodiment of a reinforced workover rig mast in a deployed position and that may be utilized by the rig of FIG. 1.
Figure 2B:
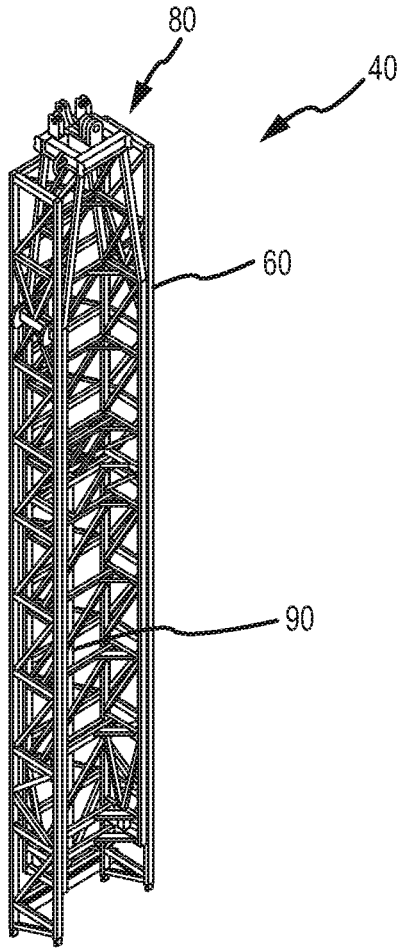
FIG. 2B is a perspective view of a portion of the reinforced workover rig mast of FIG. 2A, and illustrating a scoping cylinder for the workover rig mast.
Figure 2C:
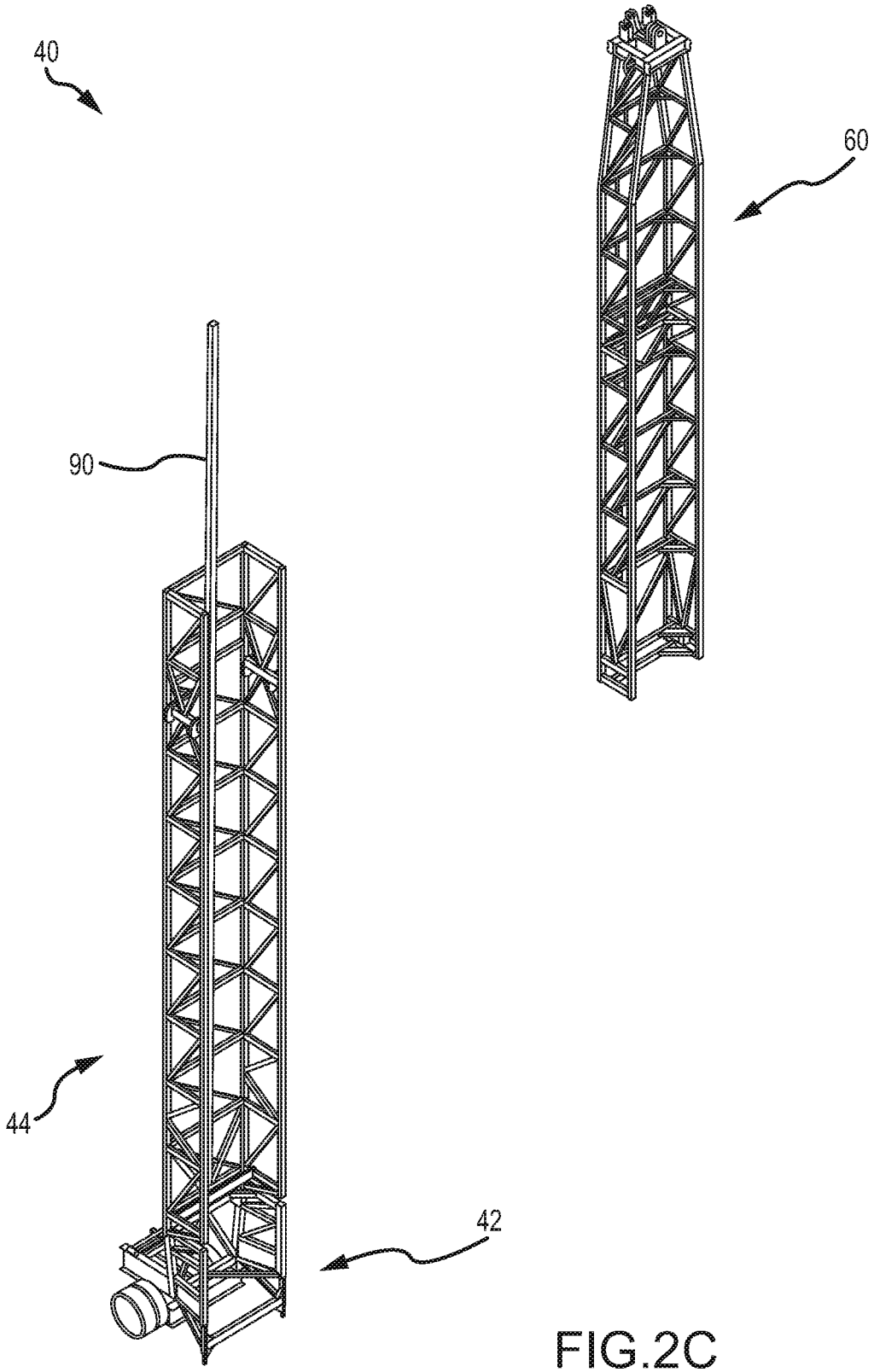
FIG. 2C is an exploded, perspective view of the reinforced workover rig mast of FIG. 2A, with the upper section of the reinforced workover rig mast being exploded away from the mid section of the reinforced workover rig mast.

One embodiment of a reinforced service or workover rig mast or derrick is illustrated in FIGS. 2A-C, is identified by reference numeral 40, and may replace the derrick 18 of the workover rig 10 of FIG. 1. However, it should be appreciated that the mast 40 may be utilized by any appropriate workover rig. The workover rig mast 40 includes a sub-base 42, a mid section 44, and an upper or top section 60. Generally, the top section 60 is slidably or telescopingly engaged with the mid section 44. Movement of the top section 60 relative to the mid section 44 is provided by what may be characterized as a scoping cylinder 90 or any other appropriate motive source. Generally, the scoping cylinder 90 may be in the form of a hydraulic cylinder or another appropriate drive source that is anchored to either the mid section 44 or the sub-base 42 of the workover rig mast 40, along with the top section 60 (the two attachment locales being movable relative to each other). The scoping cylinder 90 may be driven in at least one direction (e.g., a one-way or a two-way hydraulic cylinder may be utilized as the scoping cylinder 90).

One portion of the scoping cylinder 90 is associated with the midsection 44 or sub-base 42, while another portion of the scoping cylinder 90 is appropriately attached to or interconnected with the top section 60 of the workover rig mast 40 in any appropriate manner. Extension of the scoping cylinder 90 at least axially advances the top section 60 away from the mid section 44 to dispose the workover rig mast 40 in the deployed position of FIG. 2A, where the top section 60 is disposed at a higher elevation than the mid section 44 (i.e., is located further from the ground). The scoping cylinder 90 could also be used to pivot the workover rig mast 40 from an at least generally prone or horizontal or stowed position to an at least generally vertical or deployed position, although this may be accomplished by another source (e.g., raising ram 26). The mid section 44 and the top section 60 overlap along a section 56 in the illustrated embodiment. What is commonly referred to the art as "dogs" will typically be located in this section 56 to appropriately lock the top section 60 to the mid section 44 when the workover rig mast 40 is in the deployed position of FIG. 2A. Any appropriate locking mechanism may be utilized. Therefore, section 56 may be referred to as a locking section 56.

The above-noted extension of the scoping cylinder 90 also may be used to move the workover rig mast 40 from an at least generally prone or horizontal position to an at least generally vertical position as previously noted, although this function could be provided by another drive source as well and as noted. Typically the workover rig mast 40 will be disposed at a slight angle relative to absolute vertical in the deployed position, although such may not be required in all instances (e.g., the workover rig mast 40 may be disposed in a vertical orientation or within a small angular range of vertical). Retraction of the scoping cylinder 90 (whether actively driven, whether relying upon gravitational forces, or both) may be used to retract the top section 60 of the workover rig mast 40 relative to the mid section 44, to move the workover rig mast 40 from the deployed position of FIG. 2A to a stowed position where the workover rig mast 40 is in an at least generally prone or horizontal position (not shown), or both.

The mid section 44 of the workover rig mast 40 includes four corner supports or mid section derrick legs 46 that extend in or define the length dimension of the mid section 44. The mid section 44 also includes a plurality of what may be characterized as cross support assemblies or "internal" C-girts 48 (in contrast to the external C-girts 48' used by the prior art mast 40', and that is addressed below) that are spaced along the length dimension of the mid section 44 and that are each appropriately attached to each derrick leg 46 (e.g., welded). Each internal C-girt 48 includes a cross support 50*b* that may be characterized as defining a closed end for the mid section 44 and that is appropriately attached to a corresponding pair of mid section derrick legs 46 (e.g., welded), along with a pair of cross supports 50*a* that may be characterized as being located at or defining opposing sides of the mid section 44 and that are each appropriately attached to a corresponding pair of mid section derrick legs 46 (e.g., welded). That is, each internal C-girt 48 is at least generally in the form of a C-shaped or U-shaped structure in the illustrated embodiment, having an open end 54. Each internal C-girt 48 may be characterized as being disposed within a plane that is orthogonal to the length dimension of the mid section 44. In any case, one or more diagonal supports 52 also extend at least generally between each adjacent pair of internal C-girts 48. Each end of each diagonal support 52 may be appropriately attached to a corresponding internal C-girt 48 and/or to a corresponding mid section derrick leg 46 (e.g., welded).

The top section 60 of the workover rig mast 40 may be characterized as including a frame 62. This frame 62 includes four corner supports or top section derrick legs 63 that extend in or define the length dimension of the top section 60. The top section 60 also includes a plurality of what may or be characterized as cross support assemblies or internal C-girts 64 (in contrast to the "external" C-girts 64' used by the prior art mast 40', and that is addressed below) that are spaced along the length dimension of the top section 60 and that are each appropriately attached to each top section derrick leg 63 (e.g., welded). Each internal C-girt 64 includes a cross support 66*b* that may be characterized as defining a closed end for the top section 60 and that is appropriately attached to a corresponding pair of top section derrick legs 63 (e.g., welded), along with a pair of cross supports 66*a* that may be characterized as being located at or defining the sides of the top section 60 and that are each appropriately attached to a corresponding pair of top section derrick legs 63 (e.g., welded). That is, each internal C-girt 64 is at least generally in the form of a C-shaped or U-shaped structure, having an open end 70. Each internal C-girt 64 may be characterized as being disposed within a plane that is orthogonal to the length dimension of the top section 60. In any case, one or more diagonal supports 68 also extend at least generally between each adjacent pair of internal C-girts 64. Each end of each diagonal support 68 may be appropriately attached to a corresponding internal C-girt 64 and/or to a corresponding top section derrick leg 63 (e.g., welded).

The top section 60 includes what may be characterized as a pocket or a scoping cylinder area 72 (FIG. 7A) that is in the form of an open space to receive the scoping cylinder 90 for interfacing with the top section 60 at a desired location. This scoping cylinder area 72 extends over a segment 73 of the length of the top section 60. The scoping cylinder area 72 may be of any appropriate length. Throughout the length of the scoping cylinder area 72, the top section 60 alleviates the corresponding cross supports 66*b*, and replaces each such cross support 66*b* with what may be characterized as a top section internal cross support 74. Each top section internal cross support 74 is spaced inwardly from the corresponding end of the top section 60 by an appropriate distance (about 10 inches in one embodiment) to accommodate receipt of the scoping cylinder 90. This configuration will be discussed in more detail below in relation to FIG. 7A. In any case, a top section internal cross support 74 and the corresponding cross supports 66*a* (sides) to which it is appropriately secured also may be characterized as a cross support assembly 64. That is, a top section internal cross support 74 and two cross supports 66*a* may be characterized as being disposed with a common plane that is orthogonal to the length dimension of the top section 60, where a plurality of top section cross supports 74 are spaced along the length of the segment 73 of the top section 60.

Figure 3A:
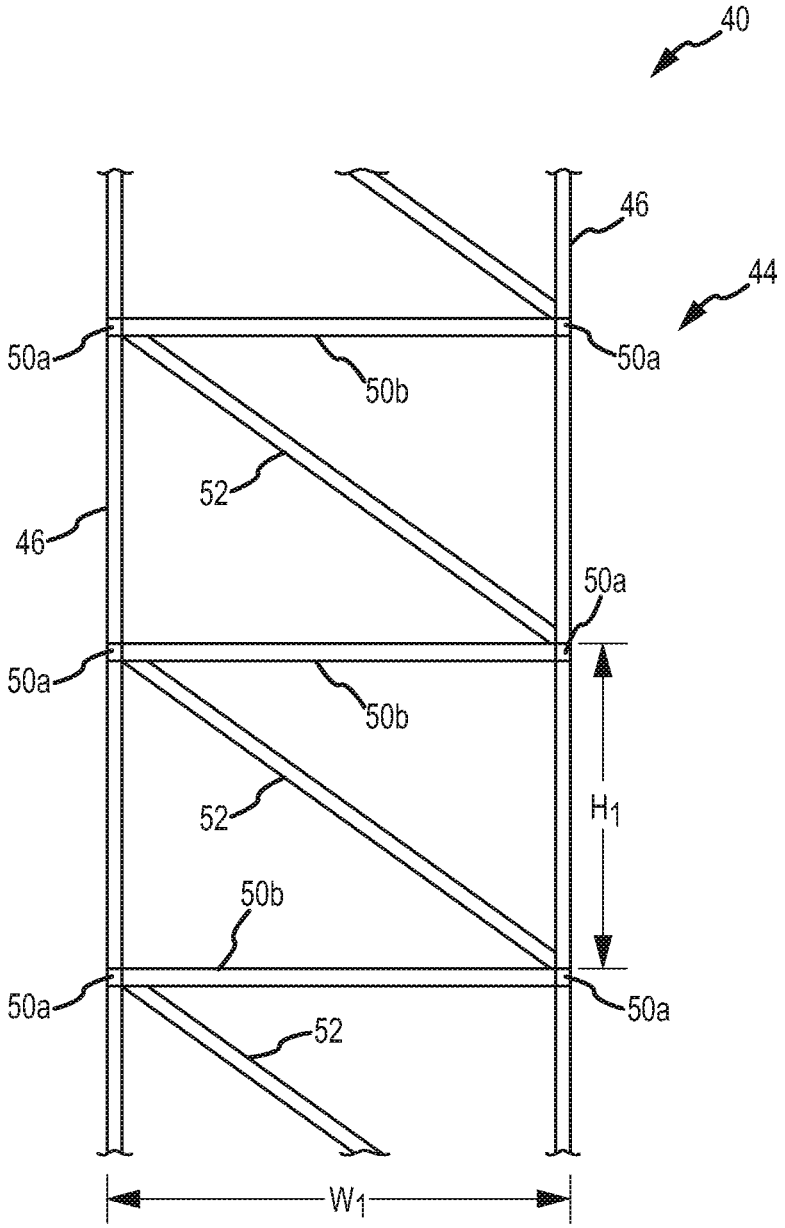
FIG. 3A is one end view of the mid section of the reinforced workover rig mast of FIG. 2A, looking into the open end of the mid section.

The workover rig mast 40 may be characterized as being structurally reinforced. There are a number of features that enhance this structural reinforcement. FIG. 3A illustrates a portion of the length of the mid section 44 of the workover rig mast 40 of FIG. 2A, looking into the open end 54. Two desirable reinforcement features are illustrated by FIG. 3A. One is the spacing of the cross supports 50*b* along the length dimension of the mid section 44, or stated another way the spacing of the internal C-girts 48 along the length dimension of the mid section 44. Each adjacent pair of cross supports 50*b* of the mid section 44, and thereby each aligned and adjacent pair of internal C-girts 48 of the mid section 44, is separated by a distance $H_1$ of no more than about 5 feet in one embodiment (e.g., adjacent cross supports 50*b* that are aligned and spaced in the length dimension are separated by a space of a magnitude $H_1$ in accordance with FIG. 3A). Therefore, for those cross supports 50*a* that are aligned and spaced in the length dimension of the mid section 44 (e.g., those cross supports 50*a* that are on a common side of the mid section 44), each such cross support 50*a* is spaced from the adjacentmost cross support 50*a* on a common side by a distance of no more than about 5 feet in the noted embodiment as well.

Another reinforcement feature utilized by the mid section 44 of the workover rig mast 40 is the spacing between corresponding pairs of cross supports 50*a* (i.e., those that are in a common horizontal position or at a common elevation when the workover rig mast 40 is disposed in a vertical orientation, or those cross supports 50*a* of a common internal C-girt 48), or stated another way the width of the mid section 44 or the width of the open end 54. Each such corresponding pair of cross supports 50*a* of the mid section 44 is separated by a distance $W_1$ of at least about 8 feet in one embodiment. That is, the width of the mid section 44 or the width of the open end 54 corresponds with the dimension $W_1$, and is at least about 8 feet in one embodiment.

Figure 3B:
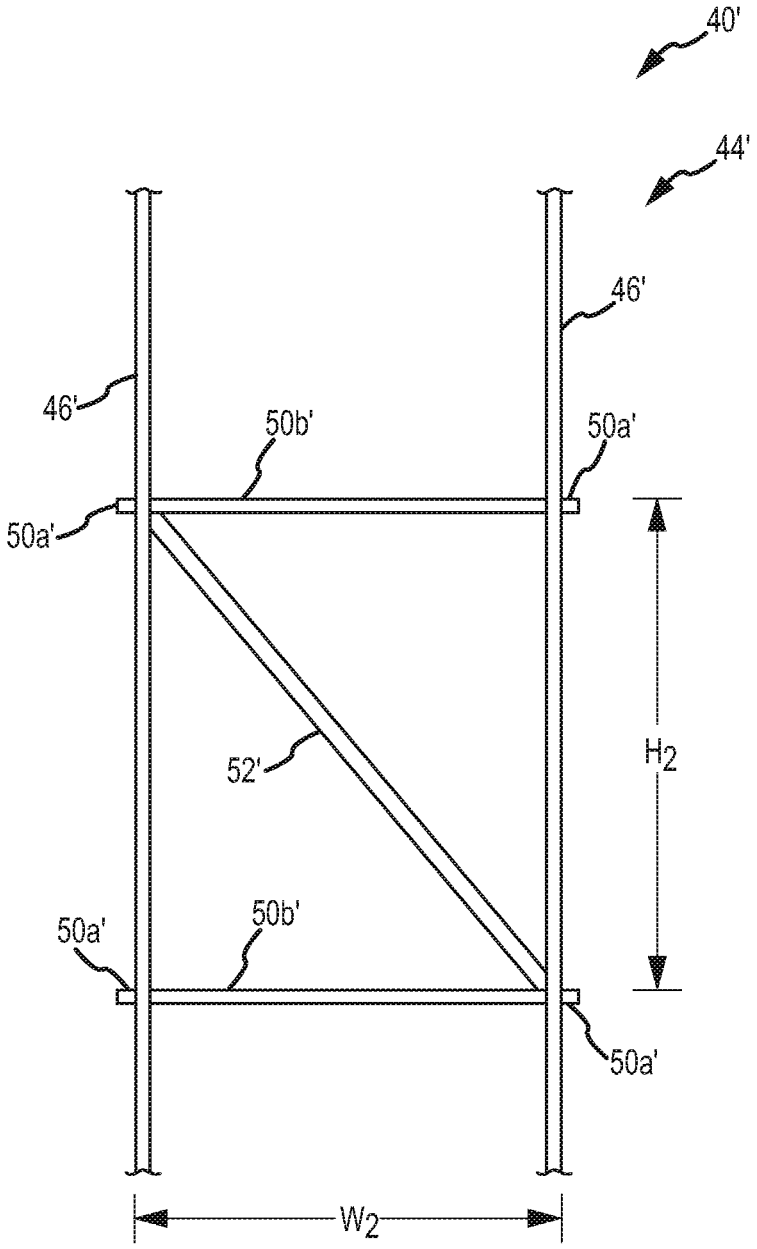
FIG.3B (PRIOR ART)
FIG. 3B is one end view of the mid section of one prior art workover rig mast, looking into the open end of the mid section.

FIG. 3B presents a corresponding view to that of FIG. 3A for the case of a prior art workover rig mast 40' having a mid section 44' (other views of this mast 40' are presented in FIGS. 4B, 5B, 6B, and 7B, and are discussed below). Corresponding portions of the workover rig masts 40, 40' are identified by the same reference numerals, although a "single prime" designation is used in relation to the prior art configuration of FIGS. 3B, 4B, 5B, 6B, and 7B to emphasize the existence of at least one difference between these two designs. Instead of the internal C-girts 48 used by the mast 40 of FIG. 3A, the mast 40 of FIG. 3B uses external C-girts 48'.

FIG. 3B illustrates a portion of the length of the mid section 44', and more specifically a pair of corner supports or mid section derrick legs 46' that extend along the length dimension of the mid section 44', a pair of cross supports 50*b'* that are spaced along the length dimension of the mid section 44', a pair of cross supports 50*a'* for each cross support 50*b'* and where each member of a given pair is spaced in the width dimension of the upper section 44', and a diagonal support 52'. Initially, it should be noted that the cross supports 50*a'* are mounted on the outside of the mid section derrick legs 46' to define an external C-girt 48', and that each corresponding pair of cross supports 50*a'* and its corresponding cross support 50*b'* (those cross supports that are disposed in a common plane and at a common elevation when the upper section 44' is disposed in a vertical orientation) are actually portions of a one-piece structure in the form of a C-girt and in accordance with FIG. 5B. That is, the external C-girts 48' are external to the mid section derrick legs 46'. In contrast, the cross members 50*a* and 50*b* are mounted on the inside of the mid section derrick legs 46 in the case of the workover rig mast 40 of FIG. 2A, to thereby define the noted internal C-girts 48. Stated another way, consider the case where a reference plane extends between the outer surface of each of the corner supports of each such mast. In the case of the workover rig mast 40 of FIG. 2A, none of the cross supports 50*a*, 50*b* of any internal C-girt 48 protrude beyond the corresponding reference plane. This is not the case in relation to the workover rig mast 40' of FIG. 3B.

The spacing between adjacent cross supports 50*b'* for the prior art workover rig mast 40' is identified as $H_2$, and which is at least about 7 feet in one known design (compared to a spacing of no more than about 5 feet for the embodiment noted above in relation to FIG. 3A). Each corresponding pair of cross supports 50*a'* of the mid section 44' is separated by a distance $W_2$ of no more than about 7 feet in one known design (compared to a spacing of at least about 8 feet for the embodiment noted above in relation to FIG. 3A). That is, the width of the mid section 44' corresponds with the dimension $W_2$, and is no more than about 7 feet in one known design.

Figure 4A:
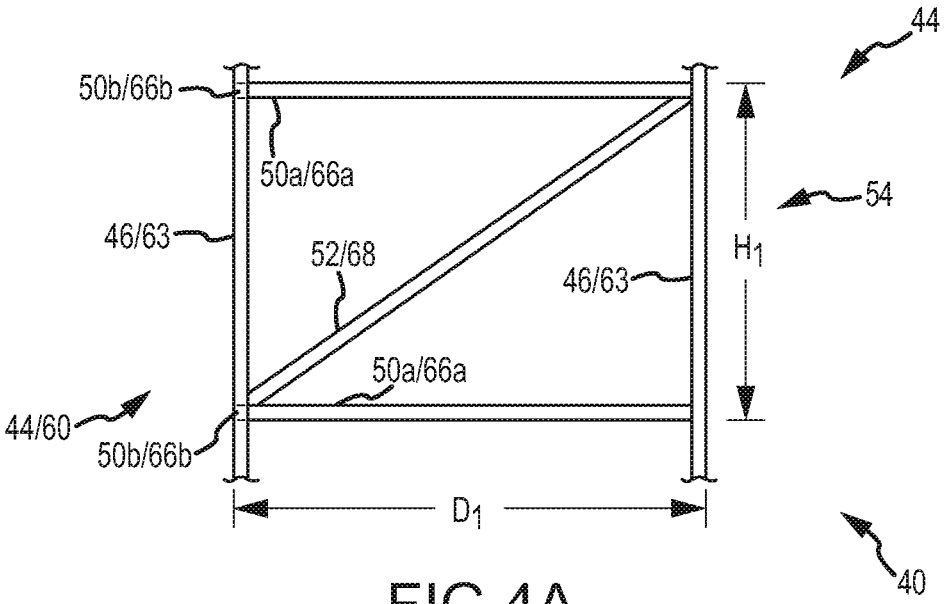
FIG. 4A is one side view of the mid section/top section of the reinforced workover rig mast of FIG. 2A.

FIG. 4A illustrates a portion of the length of the mid section 44 of the workover rig mast 40 of FIG. 2A, looking at one of the sides of the mid section 44. The same view also applies to the top section 60 of the workover rig mast 40 of FIG. 2A. Therefore the first reference numeral of each reference numeral pair in FIG. 4A applies to the mid section 44, while the second reference numeral of each reference numeral pair applies to the top section 60.

Two desirable reinforcement features are also illustrated by FIG. 4A. One is the spacing $H_1$ of the internal C-girts 48 along the length dimension of the mid section 44 and as discussed above in relation to FIG. 3A (e.g., adjacent cross supports 50*a* that are aligned and spaced in the length dimension are separated by a space of a magnitude $H_1$ in accordance with FIG. 4A). Another reinforcement feature utilized by the mid section 44 of the workover rig mast 40 and that is illustrated in FIG. 4A is the spacing between mid section derrick legs 46 on a common side of the mid section 44 (e.g., the spacing between pairs of mid section derrick legs 46 that are interconnected by cross supports 50*a*), or stated another way the depth $D_1$ of the mid section 44. Each such pair of mid section derrick legs 46 of the mid section 44 are separated by a distance $D_1$ of at least about 4 feet in one embodiment. That is, the depth of the mid section 44 corresponds with the dimension $D_1$, and is at least about 4 feet in one embodiment.

Figure 4B:
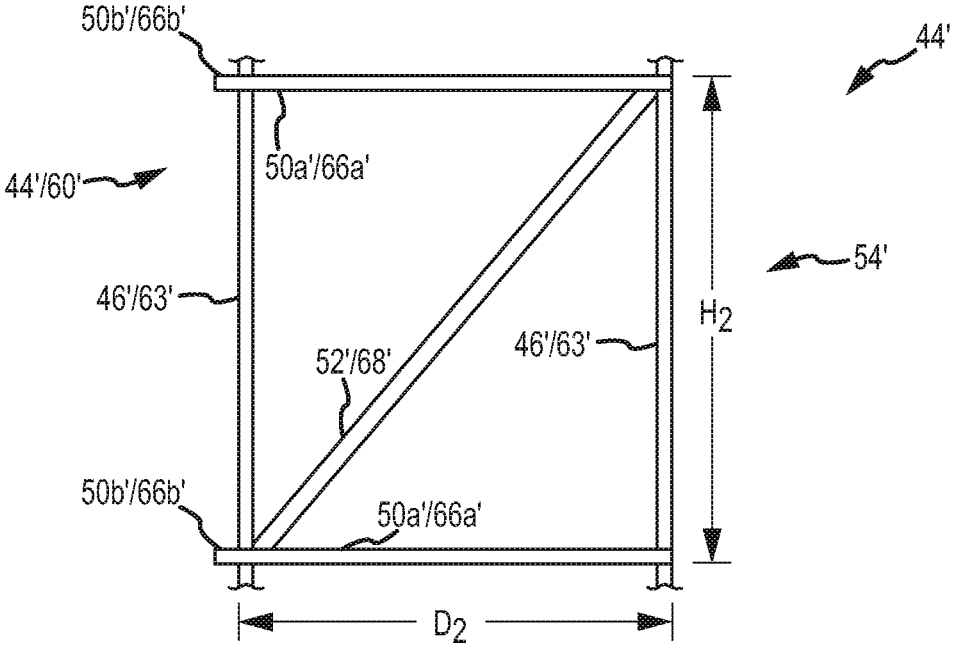
FIG.4B (PRIOR ART)
FIG. 4B is one side view of the mid section/top section of the prior art workover rig mast of FIG. 3B.

FIG. 4B presents a corresponding view to that of FIG. 4A for the case of the prior art workover rig mast 40' having the mid section 44'. This same view also applies to the top section 60' of the workover rig mast 40'. Therefore, the first reference numeral of each reference numeral pair in FIG. 4B applies to the mid section 44' while the second reference numeral of each reference numeral pair applies to the top section 60'.

FIG. 4B illustrates a portion of the length of the mid section 44', more specifically a pair of mid section derrick legs 46' that extend along the length dimension of the mid section 44', a pair of cross supports 50*b'* that are spaced along the length dimension of the mid section 44', one of the pair of cross supports 50*a'* for each cross support 50*b'* and where each member of a given pair of cross supports 50*a'* is spaced in the width dimension of the upper section 44', and a diagonal support 52'. Initially, it should be noted that the cross supports 50*a'* are mounted on the outside of the mid section derrick legs 46', and that each corresponding pair of cross supports 50*a'* and its corresponding cross support 50*b'* (those cross supports that are disposed in a common plane and at a common elevation when the upper section 44' is disposed in a vertical orientation) are actually portions of a one-piece structure in the form of an external C-girt 48'. In contrast, the cross members 50*a* and 50*b* are mounted on the inside of the mid section derrick legs 46 in the case of the workover rig mast 40 and as discussed above to define internal C-girts 48.

The spacing between adjacent cross supports 50*a'* for the prior art workover rig mast 40' is identified as $H_2$, and which is at least about 7 feet in one known design (compared to no more than about 5 feet for the embodiment noted above in relation to FIG. 3A). Each pair of mid section derrick legs 46' of the mid section 44' on a common side of the mid section 44' are separated by a distance $D_2$ of no more than about 3.5 feet (compared to at least about 4 feet for the embodiment noted above in relation to FIG. 3A). That is, the depth of the mid section 44' corresponds with the dimension $D_2$, and is about 3.5 feet for one known design.

Figure 5A:
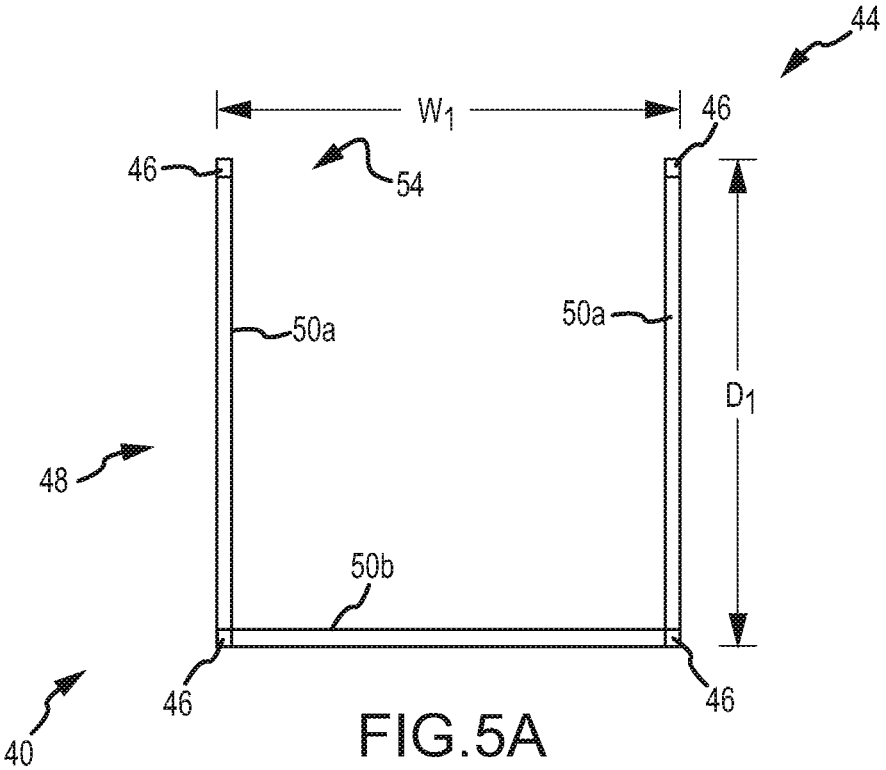
FIG. 5A is a top view of the mid section of the reinforced workover rig mast of FIG. 2A.

FIG. 5A illustrates a top view of one of the internal C-girts 48 of the mid section 44 of the workover rig mast 40 of FIG. 2A. Two desirable reinforcement features are also illustrated by FIG. 5A. One is the spacing $W_1$ between the cross supports 50*a* of a common internal C-girt 48 (e.g., those cross supports 50*a* that are coplanar and disposed at a common elevation when the workover rig mast 40 is in a vertical orientation), or stated another way the width $W_1$ of the mid section 44. Another is the depth $D_1$ of the mid section 44. These two reinforcement features were addressed above in relation to FIGS. 3A and 4A, respectively.

Figure 5B:
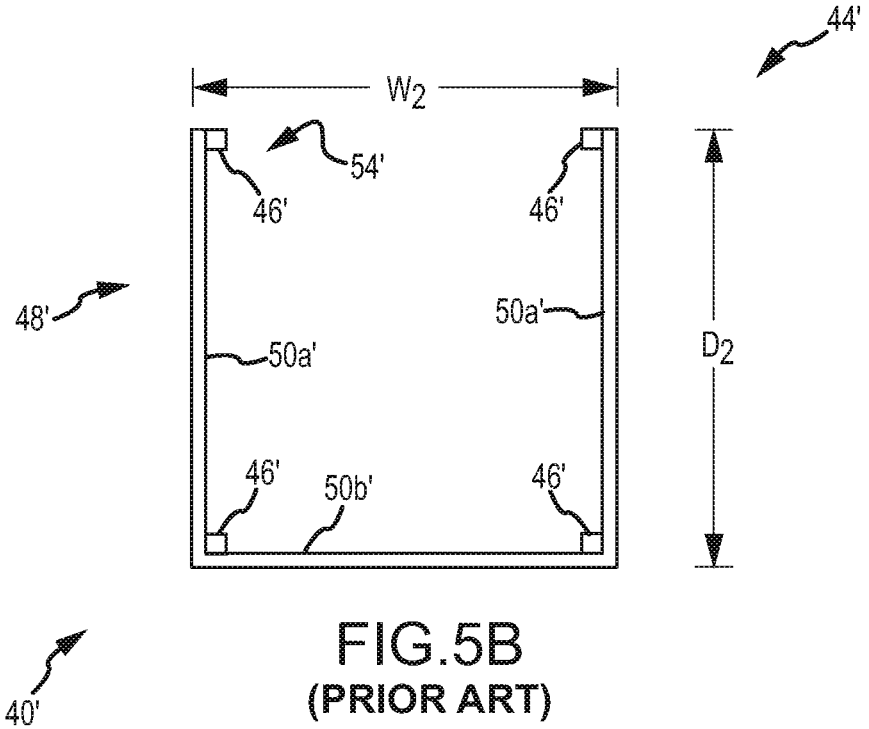
FIG.5B (PRIOR ART)
FIG. 5B is a top view of the mid section of the prior art workover rig mast of FIG. 3B.

FIG. 5B presents a corresponding view to that of FIG. 5A for the case of the prior art workover rig mast 40' having the mid section 44', and illustrates the dimensions $W_2$ and $D_2$ discussed above in relation to FIGS. 3B and 4B, respectively. FIG. 5B also illustrates the corresponding cross supports 50*a'* and cross support 50*b'* being of a one-piece configuration (e.g., in the form of an external C-girt 48').

Figure 6A:
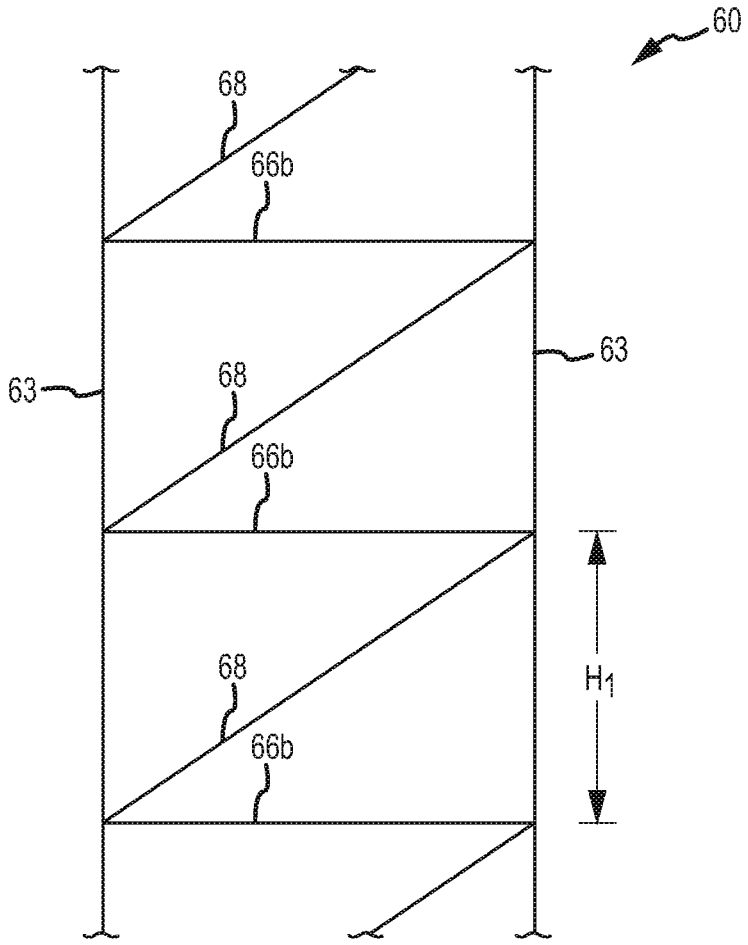
FIG. 6A is one end view of the top section of the reinforced workover rig mast of FIG. 2A, looking into the open end of the upper section.

FIG. 6A illustrates a portion of the length of the top section 60 of the workover rig mast 40 of FIG. 2A, looking into the open end 70. There are also a number of desirable reinforcement features associated with the top section 60. One is the spacing of the cross supports 66*b* along the length dimension of the top section 60, or stated another way the spacing of the internal C-girts 64 along the length dimension of the top section 60. Each adjacent pair of cross supports 66*b* of the top section 60 (except for the space between those cross supports 66*b* at the upper and lower extremes of the scoping cylinder area 72 in the view of FIG. 2A), and thereby each adjacent pair of internal C-girts 64 of the top section 60 (except for the space between those internal C-girts 64 at the upper and lower extremes of the scoping cylinder area 72 in the view of FIG. 2A), is separated by a distance $H_1$ of no more than about 5 feet in one embodiment (the same spacing utilized by the mid section 44). Adjacent cross supports 66*b* that are aligned and spaced in the length dimension are thereby separated by a space of a magnitude $H_1$ in accordance with FIG. 6A. Therefore, for those cross supports 66*a* that are aligned and spaced in the length dimension of the top section 60 (e.g., those cross supports 66*a* that are on a common side of the top section 60 and outside of the segment 73 having the scoping cylinder area 72), each such cross support 66*a* is spaced from the adjacentmost cross support 66*a* on a common side by a distance of no more than about 5 feet in the noted embodiment.

Figure 6B:
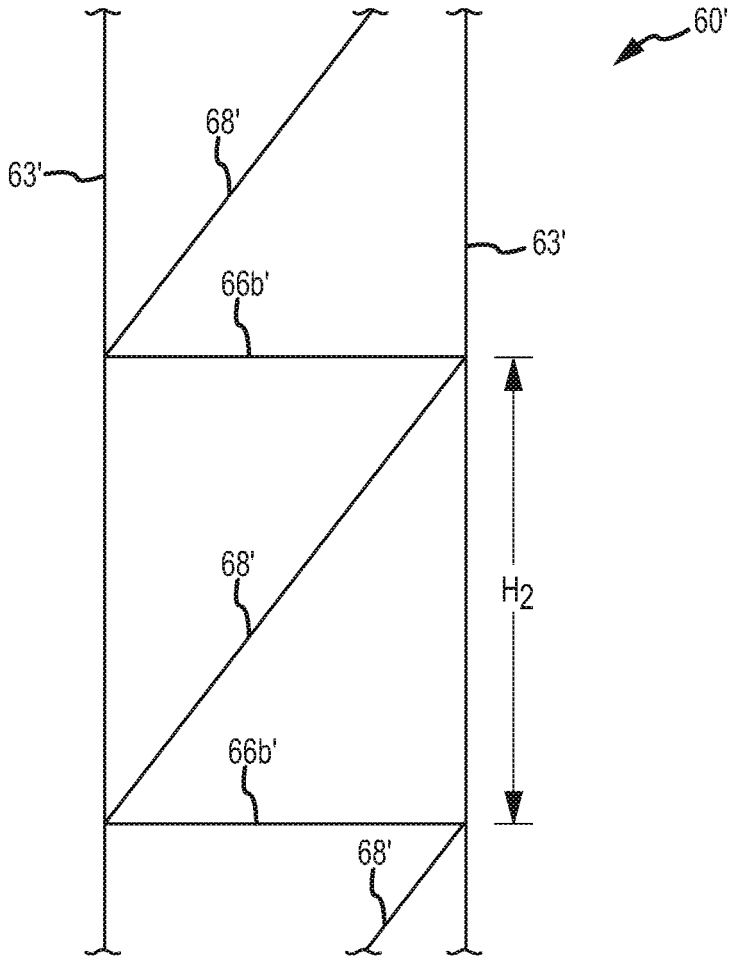
FIG.6B (PRIOR ART)
FIG. 6B is one end view of the top section of the prior art workover rig mast of FIG. 3B, looking into the open end of the upper section.

FIG. 6B presents a corresponding view to that of FIG. 6A for the case of the prior art workover rig mast 40'. That is, FIG. 6B illustrates a portion of the length of the top section 60', more specifically a pair of top section derrick legs 63' that extend along the length dimension of the top section 60', a pair of cross supports 66*b'* that are spaced along the length dimension of the top section 60', one of a pair of cross supports 66*a'* for each cross support 66*b'* and where each member of a given pair is spaced in the width dimension of the top section 60', and a diagonal support 68'. The spacing between adjacent cross supports 66*b'* for the prior art workover rig mast 40' is identified as $H_2$, and which is at least about 7 feet for one known design (compared to no more than about 5 feet for the embodiment noted above in relation to FIG. 6A).

Figure 7A:
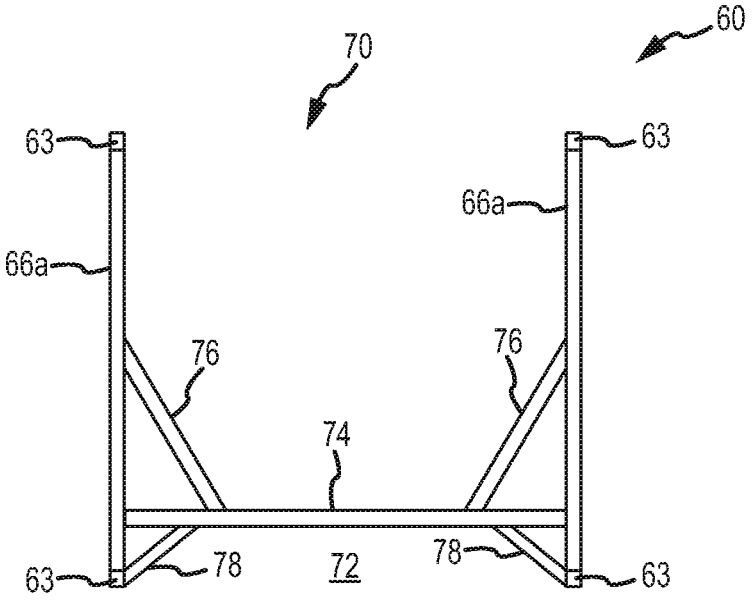
FIG. 7A is a top view of the top section of the reinforced workover rig mast of FIG. 2A.

FIG. 7A illustrates a top view of one of the cross support assemblies 64 that is located within the segment 73 of the top section 60 of the workover rig mast 40—the segment 73 again being that portion of the top section 60 having the scoping cylinder area 72 for receiving the scoping cylinder 90. Each such cross support assembly 64 includes a pair of cross supports 66*a* that are spaced in the width dimension and that are each appropriately attached to the corresponding top section derrick legs 63, along with a top section internal cross support 74 that is appropriately attached to each of its corresponding cross supports 66*a*. Each top section cross support 74 and its corresponding cross supports 66*a* are disposed within a common plane that is orthogonal to the length dimension of the top section 60, and furthermore are disposed at a common elevation when the workover rig mast 40 is disposed in a vertical orientation. Moreover, each top section cross support 74 is "spaced inwardly" from the cross supports 66*b* that define the closed end of the top section 60 (outside of segment 73) to create the scoping cylinder area 72.

Two internal gussets 76 are provided for each internal C-girt 64. One end of each internal gusset 76 is appropriately attached to the corresponding top section cross support 74. Each internal gusset 76 extends from its corresponding top section cross support 74 at least generally in the direction of the open end 70 of the top section 60 where its opposing end is appropriately attached to a corresponding cross support 66*a*. Therefore, each internal gusset 76 faces or projects toward the open end 70 of the top section 60. In one embodiment, each internal gusset 76 has a length of at least about 26 inches.

Two gussets 78 are provided for each internal C-girt 64. One end of each external gusset 78 is appropriately attached to the corresponding top section cross support 74 (e.g., welded). Each external gusset 78 extends from its corresponding top section cross support 74 at least generally away from the open end 70 of the top section 60 where its opposing end is appropriately attached to a corresponding top section derrick leg 63 (e.g., welded). Therefore, each external gusset 78 is disposed within the scoping cylinder area 72. In one embodiment, each external gusset 78 is shorter than its corresponding internal gussets 76, and in another embodiment each external gusset 78 has a length of no more than about 20 inches. Generally, the various external gussets 78 structurally reinforce the top section 60, including reducing the potential for a twisting of the top section 60 about its length dimension. Twisting of the top section 60 can be attributed to the top section 60 incorporating a crown 80, and is the location where loads are principally applied to the mast 40 during operation of the workover rig.

A number of additional characterizations may be made in relation to each external gusset 78. The two external gussets 78 associated with each internal C-girt 64 may be characterized as being disposed within a common plane. That is, the pair of cross supports 66*a* and top section internal cross support 74 of a cross support assembly 64 may be characterized as being disposed within a common plane, along with its corresponding pair of external gussets 78. This plane may be orthogonal to the length dimension of the top section 60. Therefore, the top section 60 may be characterized as including a plurality of groups of external gussets 78 that are spaced along the length dimension of the top section 60, where each group includes a pair of external gussets 78 that are associated with a common internal C-girt 64 and furthermore that are disposed within a common plane.

Although the workover rig mast 40 may be formed from any appropriate material, in one embodiment the mid section 44 and at least the top section derrick legs 63 and internal C-girts 64 of the top section 60 are formed from ASTM 500 Grade steel. This same material may be utilized for the gussets 76, 78 as well. Using this type of material, along with the above-noted reinforcement features, provides a suitable strength for the workover rig mast 40 at a reduced weight. This reduced weight is subject to a number of characterizations. One is that the workover rig mast 40 has a length of at least about 95 feet and weighs no more than about 22,000 pounds in one embodiment. Another is that the workover rig mast 40 weighs no more than about 210 pounds per linear foot in its length dimension.

Figure 7B:
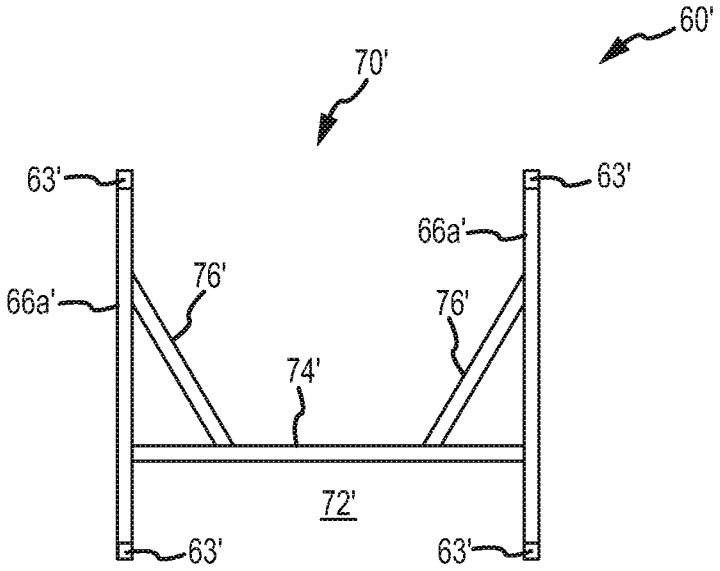
FIG.7B (PRIOR ART)
FIG. 7B is a top view of the top section of the prior art workover rig mast of FIG. 3B.

FIG. 7B presents a corresponding view to that of FIG. 7A for the case of the prior art workover rig mast 40', and which thereby illustrates one of the cross support assemblies within that portion of the top section 60' having the scoping cylinder area 72' for receiving a scoping cylinder. Each cross support assembly includes a pair of cross supports 66*a'* that are spaced in the width dimension and that are each appropriately attached to the corresponding top section derrick legs 63', along with a top section internal cross support 74' that is appropriately attached to each of its corresponding cross supports 66*a'*. Each top section cross support 74' and its corresponding cross supports 66*a'* are disposed within a common plane that is orthogonal to the length dimension of the top section 60', and furthermore are disposed at a common elevation when the workover rig mast 40' is disposed in a vertical orientation. Moreover, each top section cross support 74' is "spaced inwardly" from the cross supports 66*b'* that define the closed end of the top section 60' (outside of that portion of the top section 60' that incorporates the scoping cylinder area 72').

Two internal gussets 76' are provided for each of the noted cross support assemblies. One end of each internal gusset 76' is appropriately attached to the corresponding top section cross support 74'. Each internal gusset 76' extends from its corresponding top section cross support 74' at least generally in the direction of the open end 70' of the top section 60' where its opposing end is appropriately attached to a corresponding cross support 66*a'*. Therefore, each internal gusset 76' faces or projects toward the open end 70' of the top section 60'. In one embodiment, each internal gusset 76' has a length of at least about 26 inches. Therefore, the top section 60' lacks the reinforcement provided by the external gussets 78 of the top section 60 of FIG. 7A.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A workover rig mast, comprising:

a first mast section comprising a first frame, a scoping cylinder area, and a plurality of first cross support assemblies that are spaced along a length of said first mast section outside of said scoping cylinder area and that are each attached to said first frame and do not extend beyond an outer perimeter of said first frame whereby each said first cross support assembly is in the form of an internal C-girt, wherein said first frame of said first mast section comprises four first corner supports that each extend along said length of said first mast section and that collectively define a rectangle, wherein each said first cross support assembly of said first mast section is attached to said four first corner supports and does not protrude beyond an outer perimeter collectively defined by said four first corner supports, wherein each said first cross support assembly of said first mast section is at least generally disposed within a plane that is orthogonal to said length of said first mast section, and wherein each adjacent pair of said first cross support assemblies is separated by a distance of no more than about 5 feet; and a second mast section, wherein said first mast section telescopes relative to said second mast section and extends to a higher elevation than said second mast section when in a deployed position versus a stowed position, wherein said second mast section comprises a second frame and a plurality of second cross support assemblies that are spaced along a length of said second mast section, wherein each said second cross support assembly is attached to said second frame and does not extend beyond an outer perimeter of said second frame whereby each said second cross support assembly is in the form of an internal C-girt and such that said second mast section lacks any external C-girts, wherein said second frame of said second mast section comprises four second corner supports that each extend in said length dimension of said second mast section and that collectively define a rectangle, wherein each said second cross support assembly of said second mast section is attached to said four second corner supports and does not protrude beyond an outer perimeter collectively defined by said plurality of second corner supports, wherein said second mast section comprises a width and a depth, wherein said second mast section is a three-sided structure in a cross-section taken perpendicularly to said length of said second mast section, wherein said width of said second mast section is measured between opposing closed sides of said second mast section, wherein said depth of said second mast section is measured between an open end of said second mast section and an opposing closed end of said second mast section, wherein said width of said second mast section is at least about 8 feet, wherein said depth of said second mast section is at least about 4 feet, wherein said second cross support assemblies of said second mast section are spaced along said length of said second mast section by a distance of no more than about 5 feet, and wherein each said second cross support assembly is at least generally disposed within a plane that is orthogonal to said length of said second mast section; and wherein said workover rig mast weighs no more than about 210 pounds per linear foot along a length dimension of said workover rig mast coinciding with said length of said first mast section and said length of said second mast section.

2. The workover rig mast of claim 1, wherein said first mast section defines an uppermost portion of said workover rig mast.

3. The workover rig mast of claim 1, wherein said first mast section comprises a plurality of gussets that are attached to said first frame within said cylinder scoping area.

4. The workover rig mast of claim 1, wherein said first mast section further comprises a plurality of diagonal supports.

5. The workover rig mast of claim 1, wherein said second mast section further comprises a plurality of diagonal supports.

6. The workover rig mast of claim 1, further comprising a scoping cylinder extending through said scoping cylinder area of said first mast section and interconnected with said first frame, wherein an extension of said scoping cylinder elevates said first mast section.

7. The workover rig mast of claim 1, wherein said workover rig mast has a length of at least about 95 feet and weighs no more than about 22,000 pounds.

8. The workover rig mast of claim 1, wherein said frame comprises ASTM 500 Grade C steel.

* * * * *